US009731333B2

(12) United States Patent
Fowler

(10) Patent No.: US 9,731,333 B2
(45) Date of Patent: Aug. 15, 2017

(54) SELF-CLEANING TOP BURNER FOR A STOVE

(71) Applicant: Electrolux Home Products, Inc., Charlotte, NC (US)

(72) Inventor: Warren Fowler, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 1101 days.

(21) Appl. No.: 13/735,216

(22) Filed: Jan. 7, 2013

(65) Prior Publication Data

US 2014/0190521 A1 Jul. 10, 2014

(51) Int. Cl.

| | |
|---|---|
| ***B08B 7/00*** | (2006.01) |
| ***F24C 14/02*** | (2006.01) |
| ***F24C 15/10*** | (2006.01) |

(52) U.S. Cl.

CPC ..... *B08B 7/0071* (2013.01); *F24C 14/02* (2013.01); *F24C 15/10* (2013.01); *B08B 7/0085* (2013.01)

(58) Field of Classification Search

CPC ..... B08B 7/0071; B08B 7/0085; F24C 15/10; F24C 14/02

See application file for complete search history.

(56) References Cited

U.S. PATENT DOCUMENTS

| | | | | |
|---|---|---|---|---|
| 3,121,158 | A | 2/1964 | Bohdan | |
| 3,507,265 | A | 4/1970 | Hurko | |
| 3,783,854 | A | 1/1974 | Hurko | |
| 3,997,761 | A | 12/1976 | Gebien | |
| 4,292,501 | A | 9/1981 | Maitenaz | |
| 4,493,976 | A | 1/1985 | Wilson | |
| 4,508,097 | A | 4/1985 | Berg | |
| 4,593,676 | A | 6/1986 | Wackerman | |
| 4,852,544 | A | 8/1989 | Williams et al. | |
| 4,954,694 | A | 9/1990 | Nagai et al. | |
| 5,083,010 | A | 1/1992 | Henry et al. | |
| 5,286,943 | A | 2/1994 | Has | |
| 5,343,020 | A | 8/1994 | Waigand | |
| 5,534,678 | A | 7/1996 | Bowles et al. | |
| 5,964,211 | A | 10/1999 | Sargunam et al. | |
| 6,223,361 | B1 * | 5/2001 | Rozenblatt | B64D 11/04 4/321 |
| 6,232,584 | B1 | 5/2001 | Meyer | |
| 6,316,749 | B1 | 11/2001 | Bales et al. | |
| 6,392,204 | B2 | 5/2002 | Corda et al. | |
| 6,437,294 | B2 | 8/2002 | Allera et al. | |
| 6,492,622 | B2 | 12/2002 | Melson et al. | |
| 2008/0141997 | A1 | 6/2008 | Druin | |
| 2010/0300305 | A1 * | 12/2010 | Schon | F24C 15/10 99/375 |
| 2011/0168158 | A1 * | 7/2011 | Barkhouse | A47J 36/06 126/25 R |

* cited by examiner

*Primary Examiner* — Alfred Basichas

(74) *Attorney, Agent, or Firm* — Pearne & Gordon, LLP

(57) ABSTRACT

A pyrolytic cleaning top burner system for a stove having a normal cooking mode includes a top burner coupled to a stove, a cover for seating on the stove surface, means for heating a top burner, and an exhaust outlet. The cover covers at least the top burner in a cleaning mode. The heating means heats to a cleaning temperature in a cleaning mode that permits baked on food that is positioned under the cover to be disintegrated with heat. The exhaust outlet exhausts air from under the cover. A method for pyrolytically cleaning a top burner of a stove or cooktop is also disclosed.

19 Claims, 12 Drawing Sheets

SELF-CLEANING TOP BURNER FOR A STOVE

FIELD

The technology described herein relates to a range 10 having one or more self-cleaning top burners. More particularly, the technology relates to a cover that is positioned over a top burner such that pyrolysis can be utilized to burn off any food deposits on the burner or the surrounding area of the stove top.

BACKGROUND

The top surfaces, burners, and grates of gas fired or electric ranges 10 and cooktops 12 can be difficult to clean and may require removal of parts to adequately access areas that need to be cleaned. It is known to use pyrolysis to clean the interior of an oven. Ovens may be easily sealed by closing and locking the door to the oven. Heretofore, it has not been known to provide self-cleaning burners since their outer surface it typically uncovered.

Referring to FIGS. 12 and 13, which depict schematics of prior art burners, there are several known types of burners, including gas burners 14, open coil electric burners 16, and closed electric burners 18. Stove tops 20 will typically have four or more burners. Stove tops 20 having gas burners 16 will typically have an upper stove surface 20 having an opening 22 into which a gas burner 16 is seated. A grate 24 is positioned over the gas burner 14 and serves as a rack for seating a cooking utensil thereon, such as a pot. The gas burner 14 includes a burner 14 that is coupled to a valve. A gas supply line 26 feeds the valve and the valve is turned on and off by a knob 28. A cap 30 is typically positioned over the burner 14 to help disburse the flame from the burner 14. The burner 14 sits in a cavity 32 under the stove top surface 20. A drip pan 34 may be positioned directly beneath the burner 14 within the cavity 32. A ventilation opening 36 is typically associated with the cavity 32 in order to feed air to the burner 14 to promote efficient burning of fuel. A ventilation opening 38 may also be used to exhaust heated air from the cavity 32. The same opening may be used for both inlet and outlet of air, if desired. An example of a gas burner 14 is depicted in FIG. 12.

Ranges 10 or cooktops 12 having open coil electric burners 16 will typically include an upper stove surface 20 having an opening 22 into which an electric coil burner 16 seats. The electric coil burner 16 has an electrical connection (not shown) for connecting with an electrical connector that is positioned below the upper stove surface 20. A cavity 32 is defined below the upper stove surface 20 and may include a ventilation opening 40 that allows the entry of fresh air or the exhaust of heated air. A drip pan 34 may be positioned under the electric burner 16 and positioned in the cavity 32. An example of an open coil electric burner 16 is depicted in FIG. 13.

Ranges 10 or cooktops 12 having a closed electric burner 18 are similar to open coil electric burners 16, but have the electric burner 18 positioned under s sheet of heavy glass 42. The electric burner 18 transfers heat to the glass 42, upon which a pot seats for cooking. The glass top 42 serves as the upper stove surface 20 and a cavity 32 is defined under the glass surface 42. The electric burner heating elements 18 are positioned under the glass surface 42 and connected to an electric supply and a control knob 28 that allows the burner 18 to be turned on and off, as well as regulating the flow of electricity to the burner 18 when on. A ventilation opening 40 may be provided in the cavity in order to cool the heating elements with fresh air or to exhaust heated air from the cavity 32.

SUMMARY

A system for self-cleaning of a top burner is described. A method for pyrolytically cleaning a top burner having heating means for raising the temperature of the burner to a cleaning temperature when a cover is installed thereon is also described.

DETAILED DESCRIPTION

Figure 1:
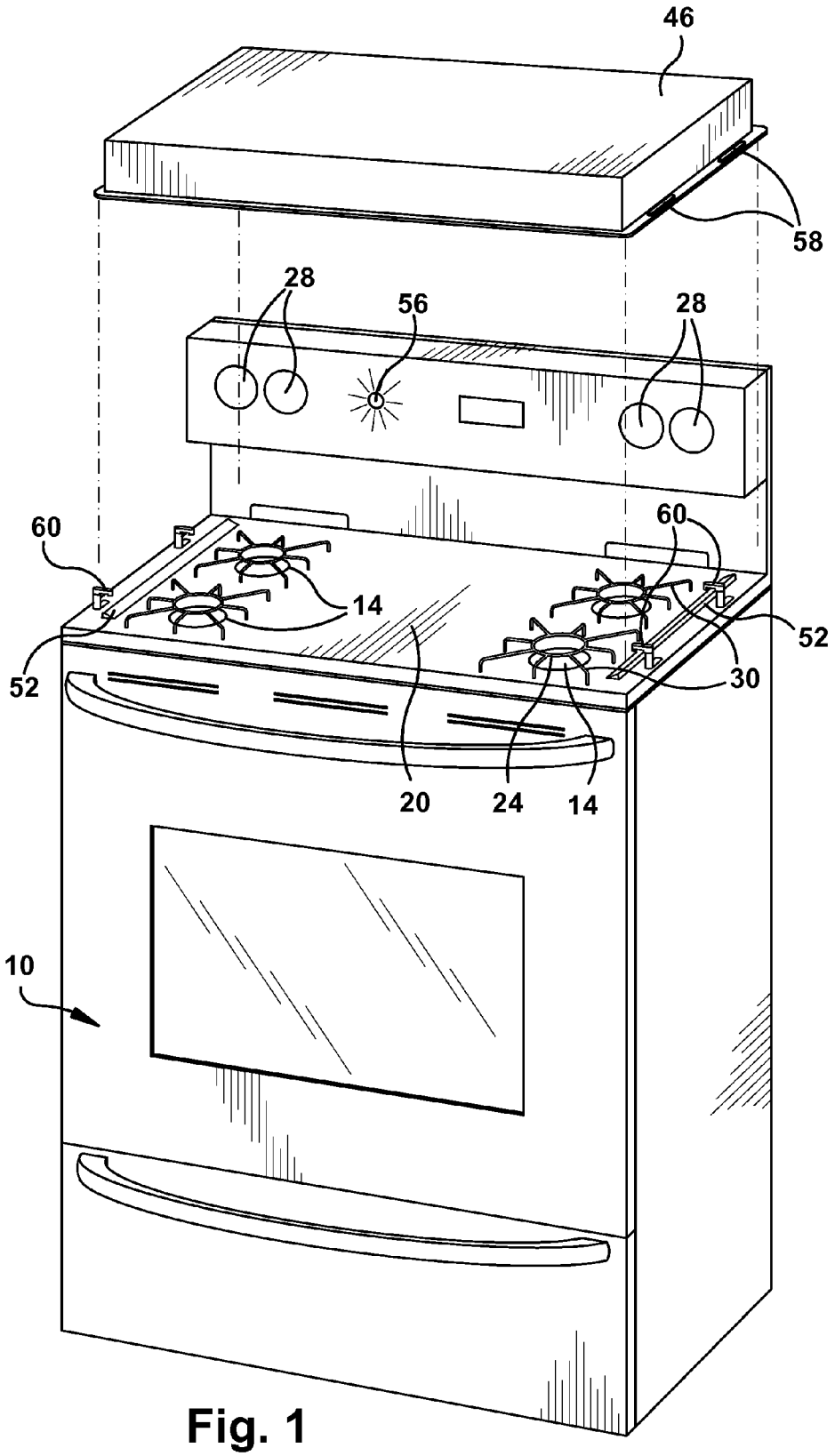
FIG. 1 is a perspective view of a range having a gas stove top that incorporates an example self-cleaning system.

An example system for the self-cleaning of a stove top 20 or cooktop 12 is disclosed herein. While self-cleaning ovens have been well known to use pyrolytics to remove stuck on food particles, there are presently no known self-cleaning stove tops 20. Thus, an example system for pyrolytically cleaning a stove top 20 and the associated burners is described herein. The example system is for use with different types of stoves, including, but not limited to a stove that have gas burners 14, open electric coil burners 16, and closed electric burners 18. The example system uses heat that is generated by the existing burners 14, 16, 18 in a cleaning mode, along with a cover 46 that is positioned over the respective burners 14, 16, 18, in order to burn off any cooked on food. Through pyrolysis, the cooked on food becomes charred and is easily wiped away after the cleaning process is completed.

The terms stove, stove top 20, and cooktop 12 are used interchangeably herein and are meant to encompass all three types of cooking surfaces. Moreover, the term stove top 20, as used in the claims, also encompasses cooktops 12 that are not attached to a range 10. The term range 10 is used to describe a combination of a stove and an oven.

The example system employs a cover 46 that is selectively positionable over the stove top 20 of the range 10 or cooktop 12 when cleaning of the stove top 20 or part of the stove top 20 is desired. The cover 46 may be insulated in order to prevent burning a user and may cover the entire stove top 20 or part of the stove top 20. A cover 46 may cover a single burner and the surrounding area on the stove top 20, half of the stove top 20, or the entire stove top 20. For example, in the case of a 30 inch range 10 with four (4) burners 14, 16, 18, a cover 46 could cover each of the front and back burners 14, 16, 18 on one side of the range 10 so that two burners 14, 16, 18 could be cleaned at a time. Other variations will be evident to those of skill in the art. The example system provides a pyrolytic self-cleaning operation for the top surfaces 20, 32, 44, burners 14, 16, 18 and grates 24. The advantage of the example system is to allow ease of cleaning for the stove top 20 or cooktop 12.

Certain types of foods cause more problems with cleaning than others. The example system is non-discriminating and helps to burn off any type of foodstuff that is caked or otherwise attached to the burner and the surrounding surfaces. The cover 46 helps to reflect heat from the burner downwardly, resulting in pyrolysis of the burner 14, 16, 18, grate 24, and surrounding surface 20, 32, 44.

The cover 46 may be provided as a separate optional piece that may be purchased separately, or could be an integral part of the range 10 or cooktop 12. The range 10 may include a storage pocket or recess 48 that is positioned in the vicinity of or adjacent to the burners 14, 16, 18 so that the cover 46 can be pulled from the pocket 48 and positioned over the burner(s) 14, 16, 18. Alternatively, the cover 46 can be a separate part that can be stored separately from the range 10 and pulled out and installed when cleaning is needed. For example, the cover 46 could be suspended on a back surface of the range 10 provided there is room to do so, or stored in a separate cabinet away from the range. If the cover 46 is stored in a pocket or recess 48 on the range 10, a door 50 may cover 46 the opening to the pocket 48 so that when the cover 46 is not in use, it is entirely out of sight.

During cleaning, the cover 46 is positioned on the top surface 20 of the range 10 and may be locked in place. The cover 46 may include a surface or raised groove 52 against which a lock 54 may engage, with the lock 54 extending from the stove surface 20, or vice versa. The locks or locking surfaces 54 may be removable from the stove surface 20 or they may be integral with and irremovable from the stove surface 20. Locks 54 may be positioned around the vicinity of the cover 46 at various locations, such as the sides, the front and back, the corners, or a combination thereof. A lock 54 is advantageous because it will help in preventing unwanted heat loss during the cleaning process and will help to prevent dislodgement of the cover 46, which could result in harm to a user or the surroundings, although a lock 54 is not required. Regardless of whether a lock 54 is provided, the example system may include a warning system with warning lights 56 when the self-cleaning system is in operation. Grooves or other surface treatments 52 could be provided on the upper surface 20 of the stove to provide a seating place for the cover 46, if desired.

In addition to a regular cooking mode, the stove or cooktop 12 is equipped with a cleaning mode that is programmed into a controller (not shown) of the stove or cooktop 12. The cleaning mode allows the burners 14, 16, 18 to heat to a higher temperature than they would normally operate at in order to reach a temperature that is conducive to pyrolysis.

Because a gas burner 14 needs air in order to burn, and because the burner 14 is the primary source of heat for the self-cleaning process, the gas range 10 will include an air inlet 36 as well as an air outlet 38. The air inlet and outlet 36, 38 may be coupled to the cavity 32 that is positioned under the gas burner 14, or could be coupled to the cover 46. The air inlet 36 and outlet 38 may be one in the same 40 or separate inlets and outlets 36, 38 may be provided. Multiple inlets and outlets 36, 38, 40 could be provided for each burner 14, if necessary. A fan (not shown) could be installed in the cavity 32 of the stove top 20, in order to promote air circulation and efficient burning.

In the case of an open electric burner 16, an exhaust outlet 38 is provided in order to exhaust heated air and fumes from the cleaning process. A single exhaust outlet 38 may be provided in the cavity 32 or cover 46, or multiple exhaust outlets 38, 40 could be provided. For example, an exhaust outlet 38 could be provided for each burner 16 or for each cover 46 area. The exhaust outlet 38 may be on the side, rear or front surfaces of the cavity 32 under the stove top 20. Alternatively, the exhaust 38, 40 could be in the cover 46. The exhaust 38, 40 preferably exhausts the heated air to the kitchen environment.

In the case of a closed electric burner 18, an exhaust inlet 36 and/or outlet 38 may be provided in both the cavity 32, in the cover 46, or in both. The cavity 32 exhaust inlet and outlet 36, 38, 40 may be used for moving air around the electric burner 18, if desired. The cover exhaust inlet and outlet 36, 38, 40 could be used to move exhaust gases to the kitchen environment and out from under the cover 46.

The example cover 46 is preferably coated with a suitable material on the interior and exterior to be able to withstand high temperatures, such as those greater than for normal cooking. For example, the cover 46 could be coated with thermodynamic paint or ink. The cover 46 may also be insulated in order to prevent burns to the user. Any type of insulation may be used, as well as any construction, as known by those of skill in the art.

Temperatures typically used for pyrolysis in ovens are about 800 degrees F. The burner self-cleaning method described herein may utilize a temperature on the order of about 800 degrees F. or something less, such as about 500 to about 600 degrees F. Different temperatures may be needed based upon how dirty the burner areas are. In this regard, sensors (not shown) may be utilized, if desired, to monitor the temperature and/or to assist in determining when pyrolysis of foodstuffs occurs.

Figure 2:
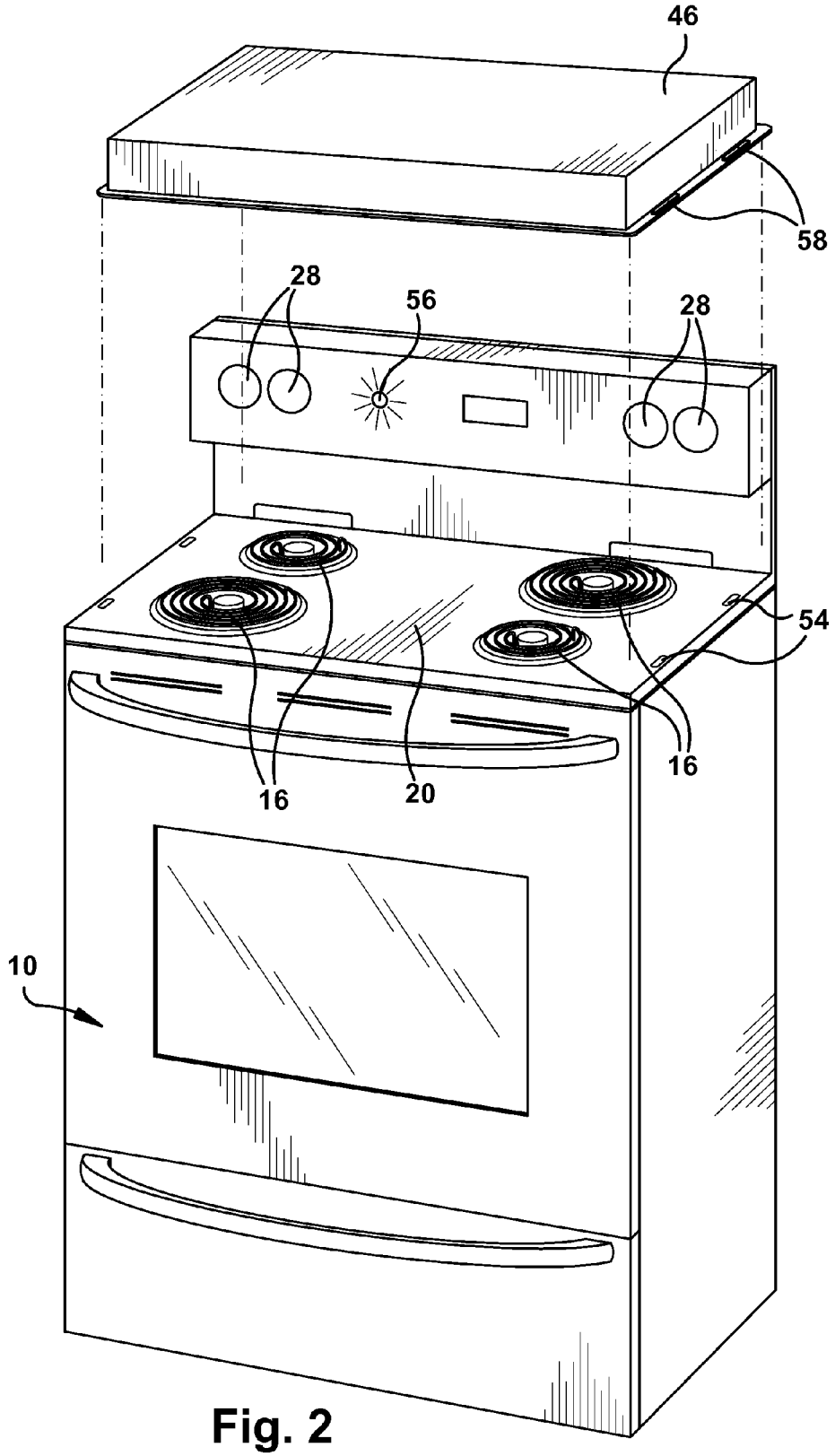
FIG. 2 is a perspective view of a range having an open coil electric burner that incorporates an example self-cleaning system.
Figure 3:
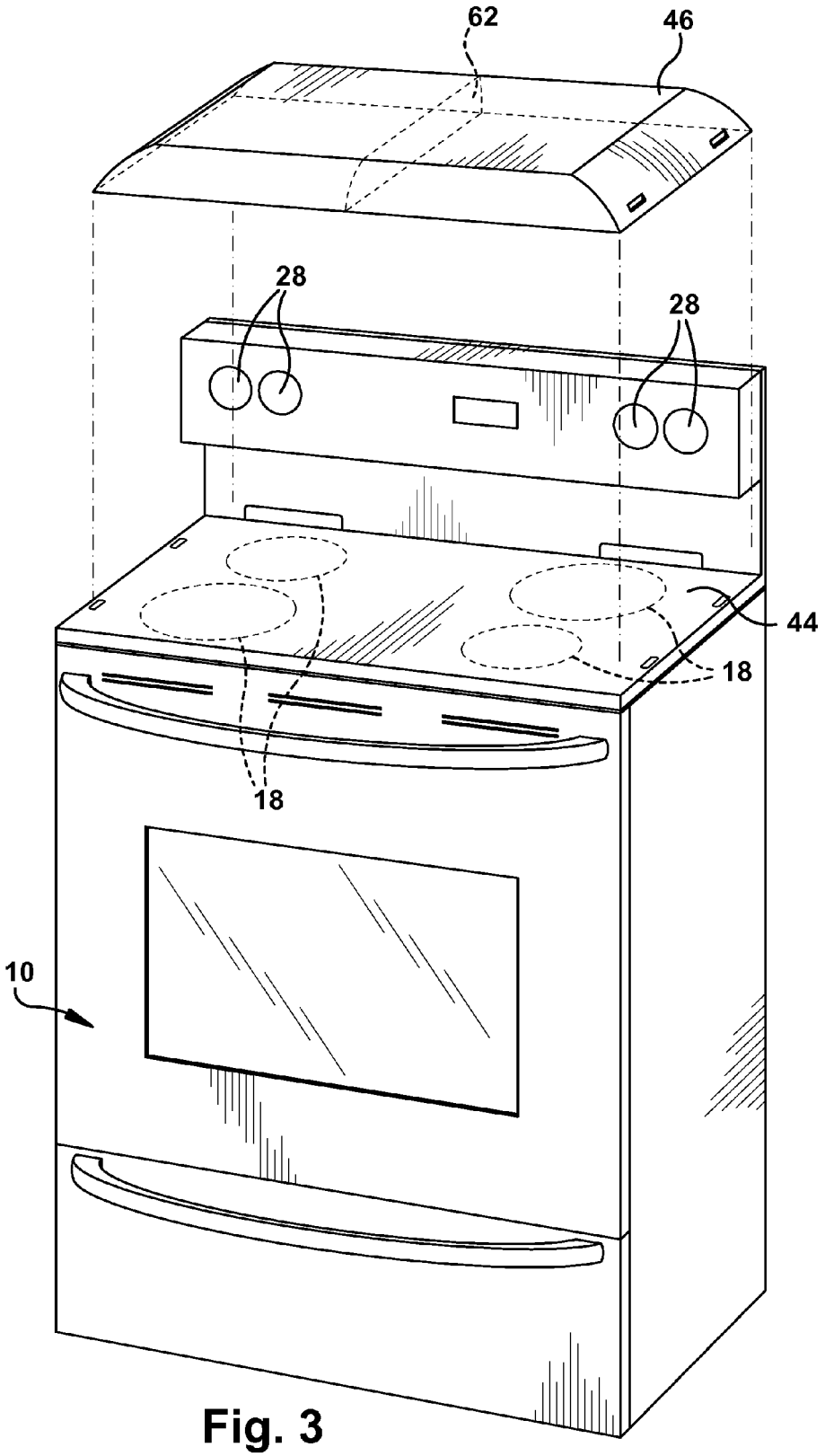
FIG. 3 is a perspective view of a range having a closed electric burner that incorporates an example self-cleaning system.

Referring to FIGS. 1-3, an example range 10 having a stove top 20 is depicted. FIG. 1 depicts a stove top 20 having gas burners 14, FIG. 2 depicts a stove top 20 having open coil electric burners 16, and FIG. 3 depicts a stove top 20 having closed electric burners 18. A cover 46 is shown positioned above the stove tops 20 for positioning on the stove tops 20. FIG. 1 shows grooves 52 positioned on the stove top 20 for mating with an edge of the cover 46 as well as locking mechanisms 54 that are used to lock the cover 46 down on the stove top 20 on the sides of the cover 46. In this regard, a ledge 58 is provided on the cover 46 for mating with a hook, latch, or similar locking device 60 that is coupled to the stove top 20. The locking devices 60 may be integral with the cover 46 or stove top 20, or could be removable and replaceable on the stove top 20. In the example shown in FIG. 1, the locking mechanisms 60 are positioned on the sides of the cover 46. FIG. 1 also shows inlet and/or exhaust ports 36, 38, 40 at the rear of the stove top 20 for exhausting gases from the cavity 32 under the burners 14, 16, 18.

The range 10 includes knobs 28 that are coupled to a controller (not shown). The controller has programming that establishes a cooking mode as well as a cleaning mode. The controller must be set to cleaning mode and the cover 46 installed in order for cleaning mode to engage. The stove top 20 may have a sensor (not shown) that communicates with the controller to indicate that the cover 46 is positioned on the stove top 20. A light 56 may be lighted to indicate on the range 10 or cooktop 12 when the stove top 20 is in cleaning mode.

FIGS. 2 and 3 are similar to FIG. 1 in that they incorporate a cover 46 that covers the top surface 20 of the stove top 20. The overall shape of the cover 46 is slightly thinner than that shown in FIG. 1 because the burner 14 in FIG. 1 has grates that extend up from the stove top 20 a greater distance, thereby requiring a taller cover 46. The cover 46 may take on different shapes. In FIG. 3, the cover 46 does not utilize a locking means and a center wall 62 is provided down the center of the cover 46 so that heat from the left side of the stove top 20 will not easily migrate to the right side of the stove top 20. This design may be advantageous if only half of the stove is dirty.

The examples shown in FIGS. 1-3 have a cover 46 that seats over the majority of the stove top 20. Other designs could be utilized that snap onto the sides of the stove instead of ones that seat on the stove top 20 in order to completely cover the top surface 20 of the stove, if desired. Alternatively, covers 46 that cover only a portion or half of the stove top 20 could be utilized, as discussed in greater detail below.

Figure 4:
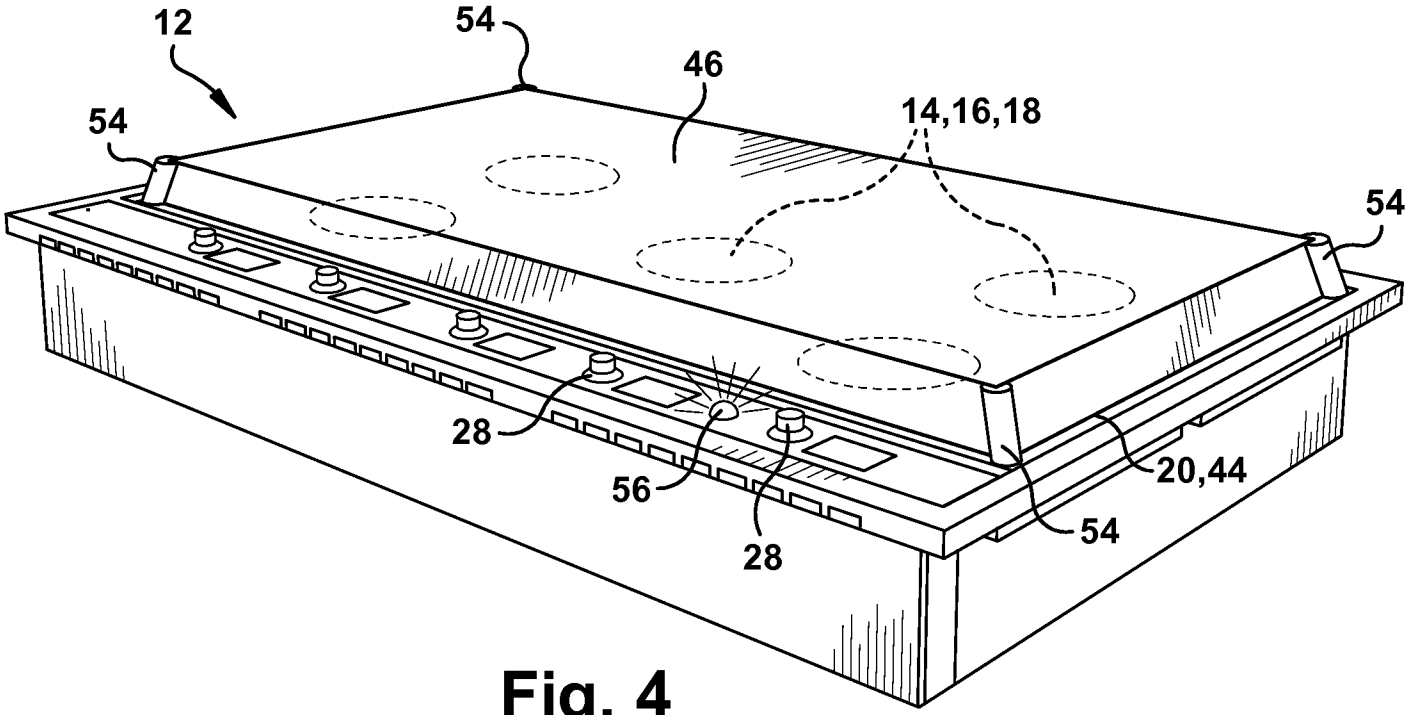
FIG. 4 is a perspective view of a cooktop having an example self-cleaning system installed thereon.
Figure 5:
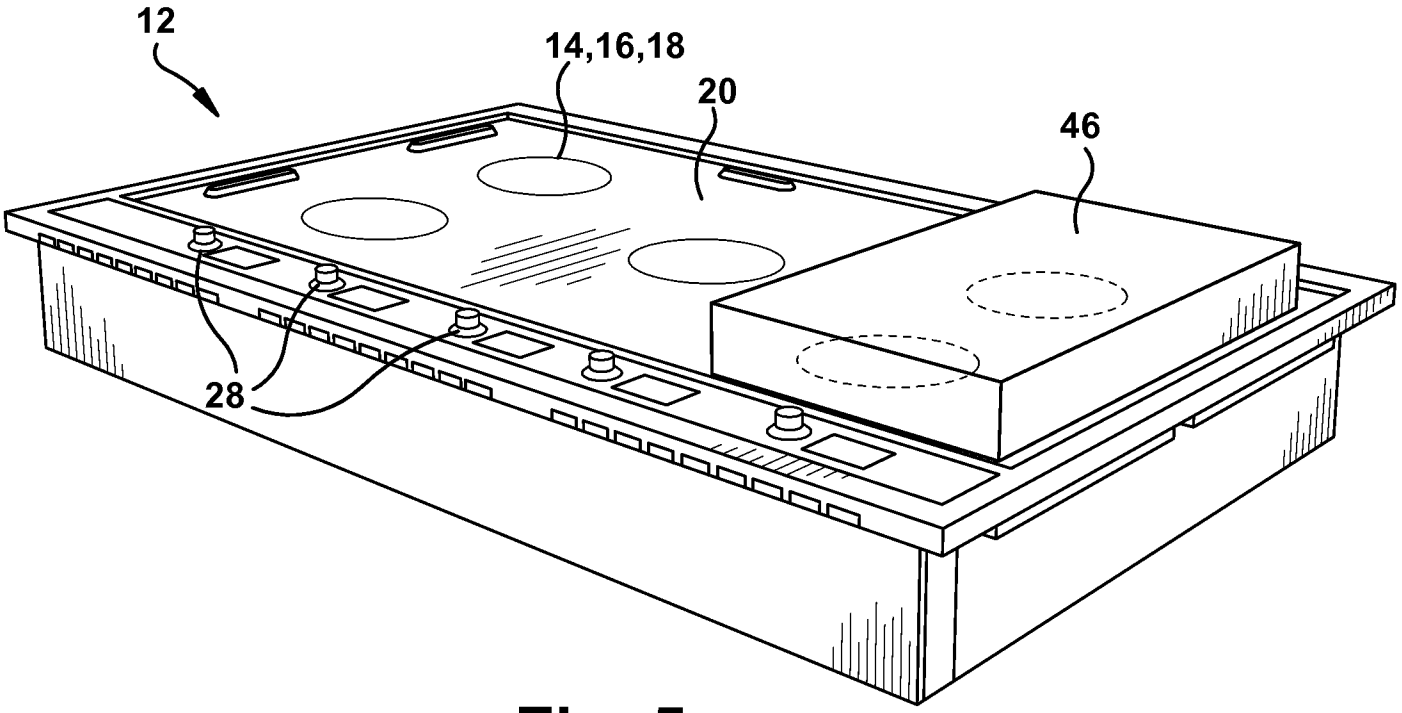
FIG. 5 is a perspective view of a cooktop having an alternative example self-cleaning system installed thereon.
Figure 6:
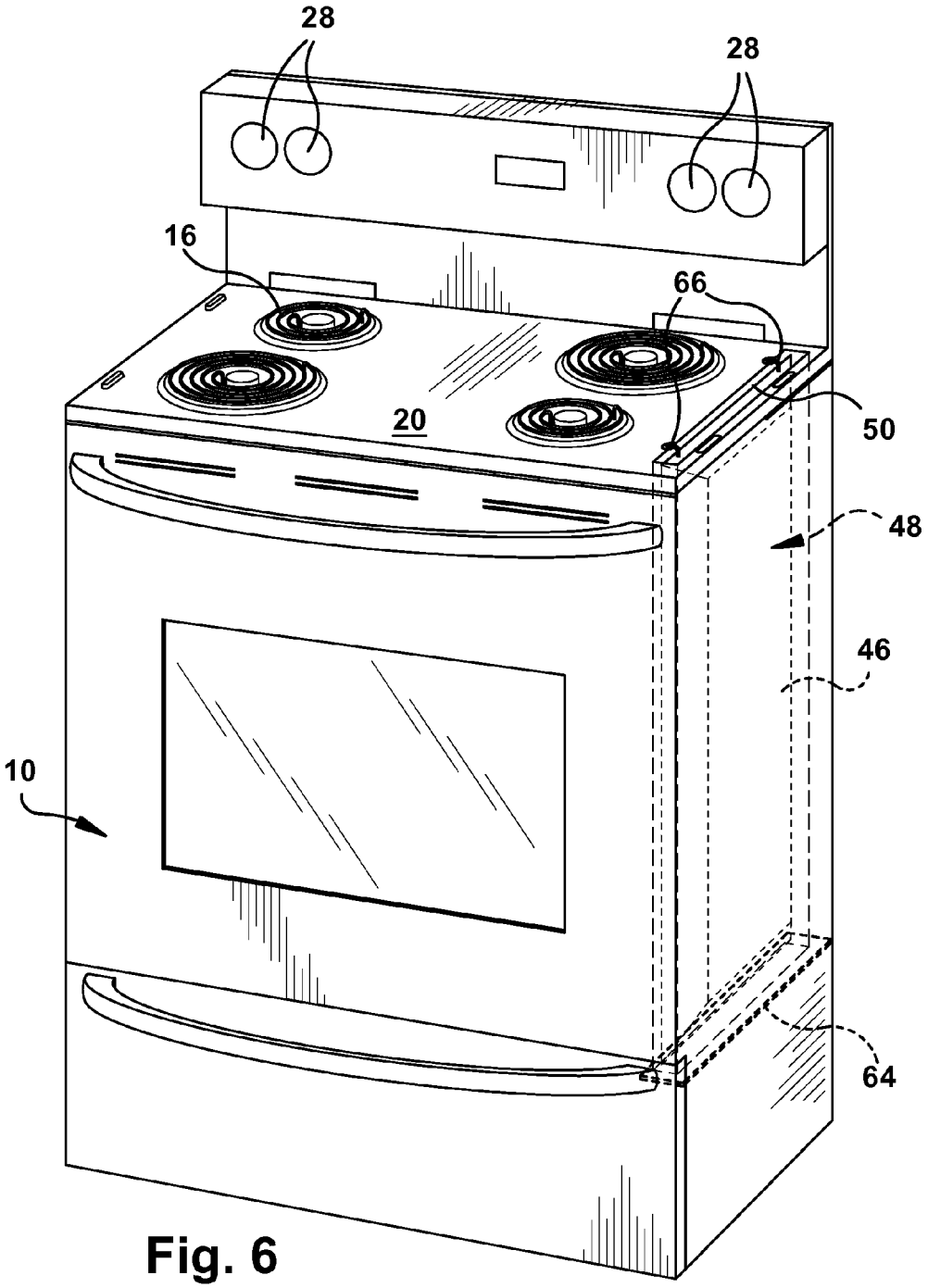
FIG. 6 is a perspective view of a range incorporating an example self-cleaning system, with the cover for the self-cleaning system being stored in a recess of the range.

FIGS. 4 and 5 depict a cooktop 12 that may be positioned in a recess on a counter. Cooktops 12 are presently designed in different widths depending upon the number of burners that a user requires. For example, 30" cooktops 12 may provide 4 or 5 burners 14, 16, 18 while 36" cooktops 12 may provide 6 burners 14, 16, 18 and 48" cooktops 12 may provide 8 burners 14, 16, 18. FIG. 4 depicts an example cooktop 12 having five burners 14, 16, 18. In this example, a half cover 46 cannot be utilized because it would cover the center of the center burner. Thus, a full-size cover 46 is utilized. Divider walls 62 could be provided under the cover 46 in order to permit a user to clean separate sections of the cooktop 12 at a time. The cooktop 12 includes locking members 54 that extend up from the corners of the cooktop 12 and that clamp down on the corners of the cover 46. Any type of locking mechanisms 54 may be utilized, with the examples shown herein only being examples of what may be utilized.

FIG. 5 depicts a similar cooktop 12 to that shown in FIG. 4, but depicts a partial cover 46 that covers two of the five burners 14, 16, 18. Differently sized covers 46 may be utilized as desired. A set of covers 46 could be provided with the range, if desired, that includes a full-size cover 46, a partial cover 46, and a single burner cover 46, if desired. Alternatively, differently sized covers 46 could be sold as optional parts.

FIGS. 6-9 depict an example of how the cover 46 may be stored in a range. In this example, a recess 48 is provided along the side of the range 10 that is accessible from the stove top 20. The cover 46 may seat on a shelf 64 within the recess 48 or may have hooks 66 to suspend it within the recess 48. The cover 46 may be suspended in any known manner in the recess 48. The recess 48 has a cover 46 that can be removed and replaced in order to remove the cover 46 from the recess 48 and so as to provide a pleasant aesthetic appearance when the cover 46 is stored in the recess 48. While a single recess 48 is shown, multiple recesses 48 could be provided and the recesses 48 could be located at different locations.

Figure 7:
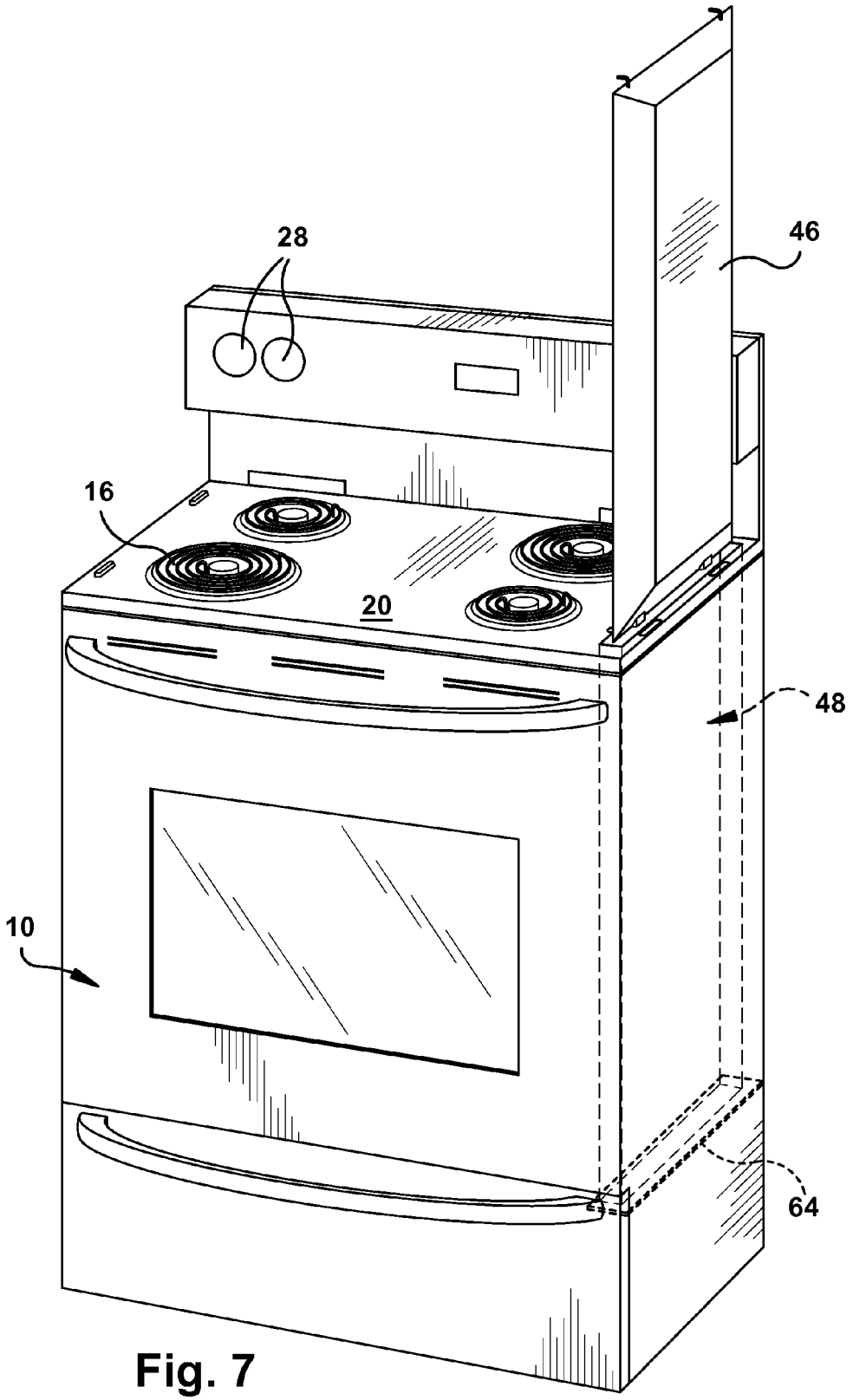
FIG. 7 is a perspective view of a range similar to that shown in FIG. 6, but showing the cover removed from the storage recess.
Figure 8:
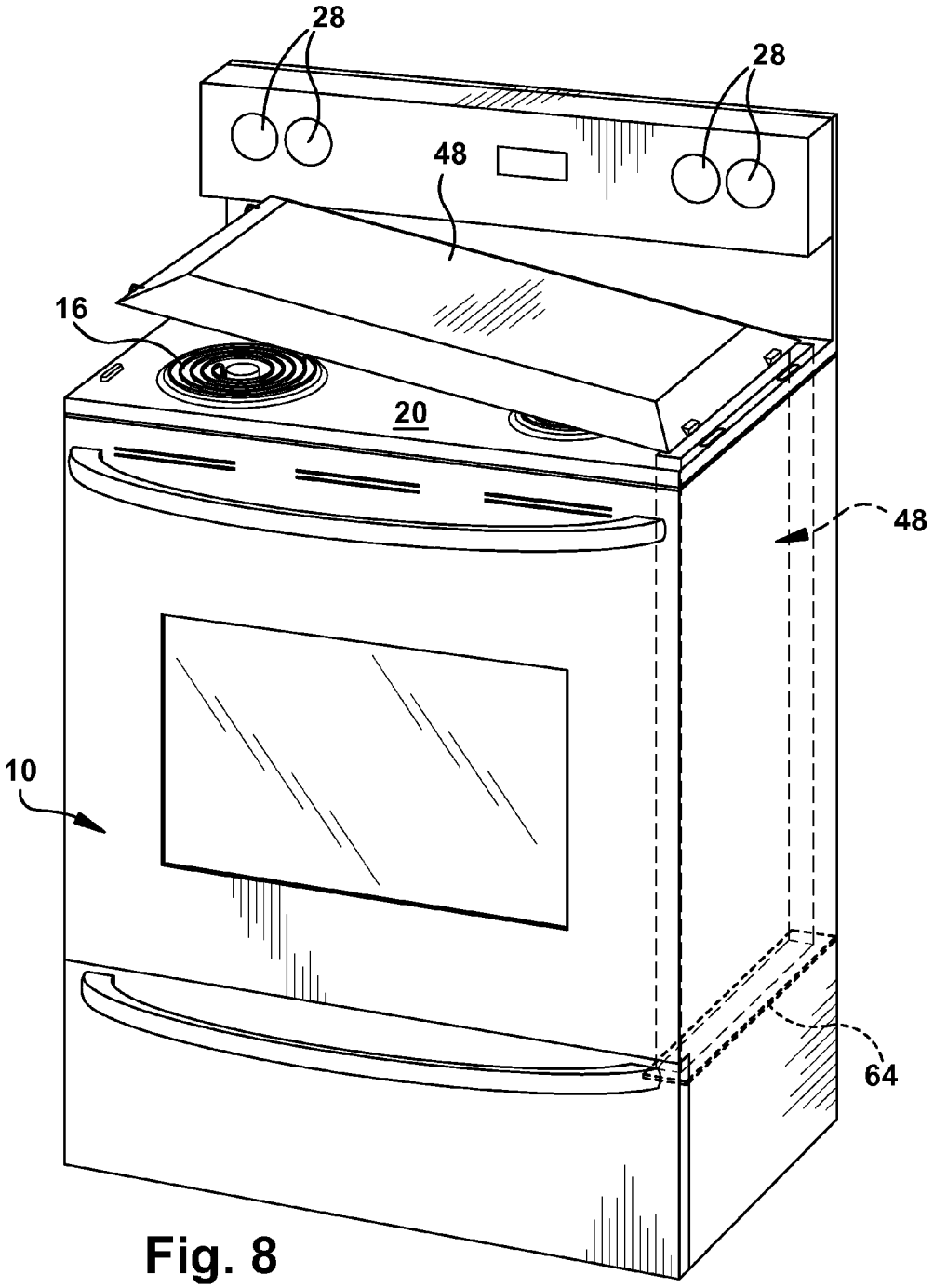
FIG. 8 is a perspective view of a range similar to that shown in FIGS. 6 and 7, but showing the cover rotated downwardly onto the stove top surface.
Figure 9:
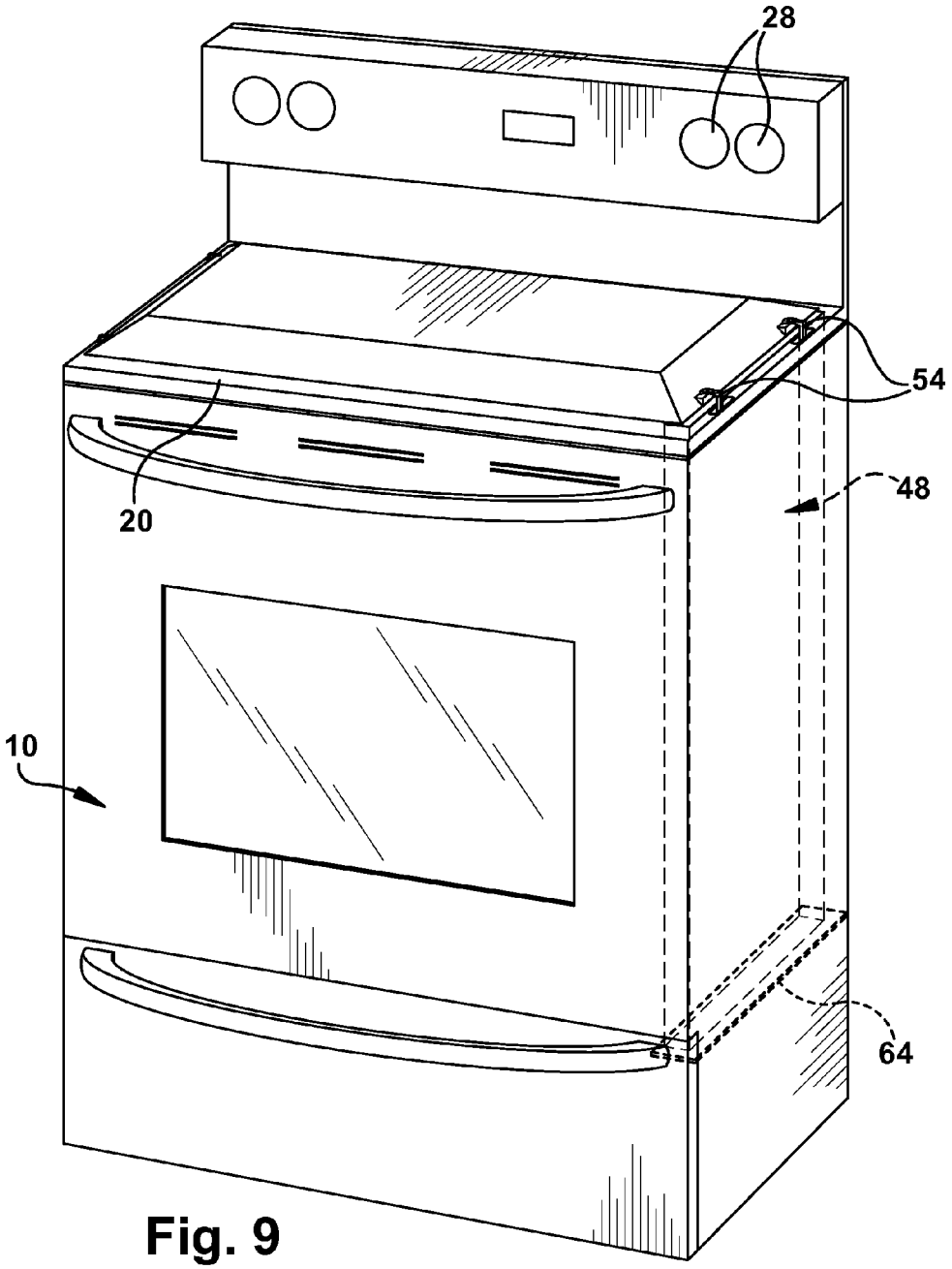
FIG. 9 is a perspective view of a range similar to that shown in FIGS. 6 to 8, but showing the cover in a locked cleaning position on the stove top surface.

FIG. 7 shows the recess 48 being opened in order to allow removal of the cover 46 from the recess 48, with the cover 46 pulled out of the recess 48. FIG. 8 shows the cover 46 being rotated downwardly into position over the stove top 20. FIG. 9 shows the cover 46 positioned on the cooktop 12. As with prior examples, the cover 46 may be locked into position, if desired. In addition, the cover 46 could be hinged (not shown) to the range 10 in some manner, if desired.

Figure 10:
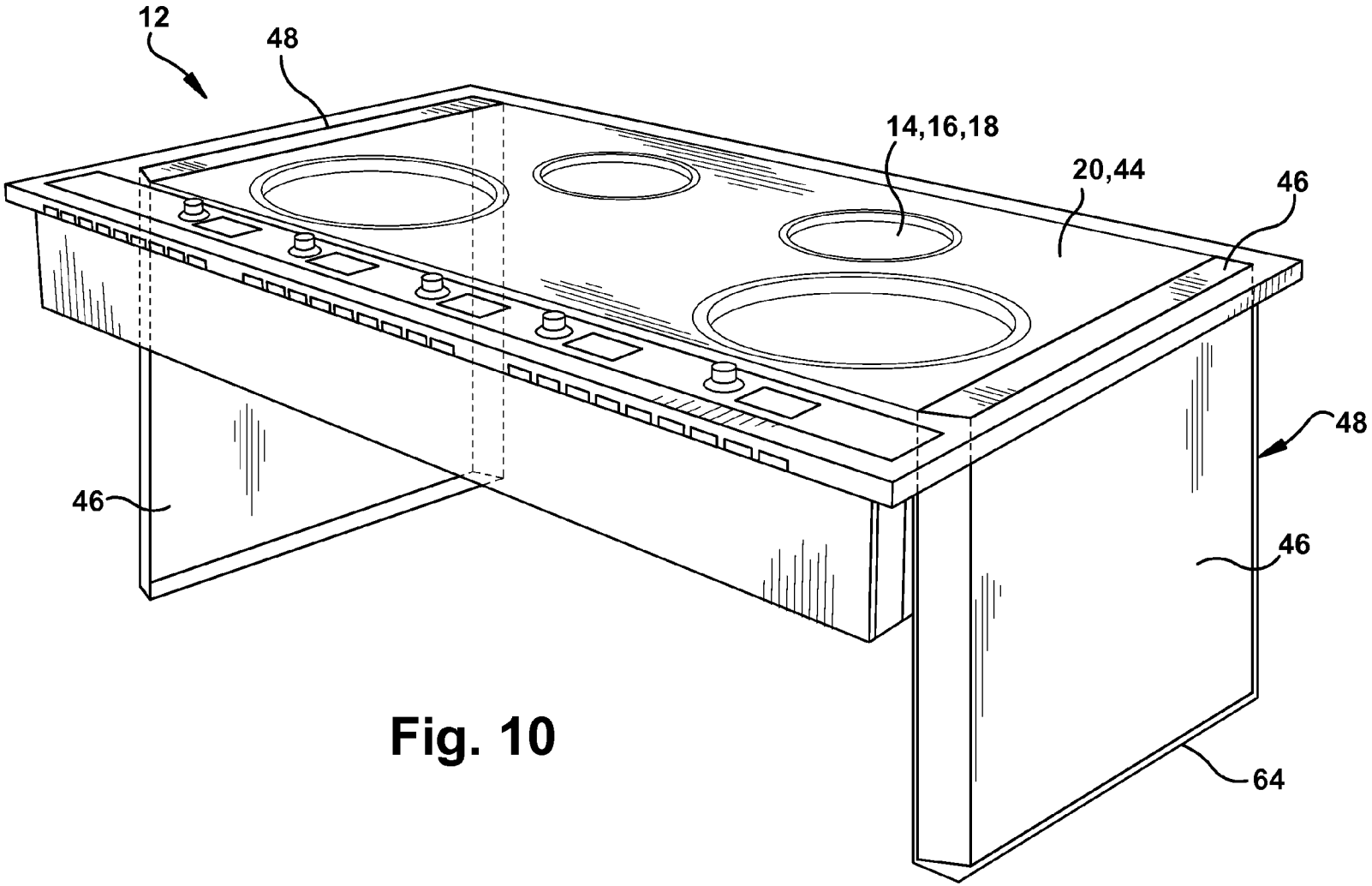
FIG. 10 is a perspective view of a cooktop for use with an example self-cleaning system, with two cleaning covers being stored in recesses along the sides of the cooktop.
Figure 11:
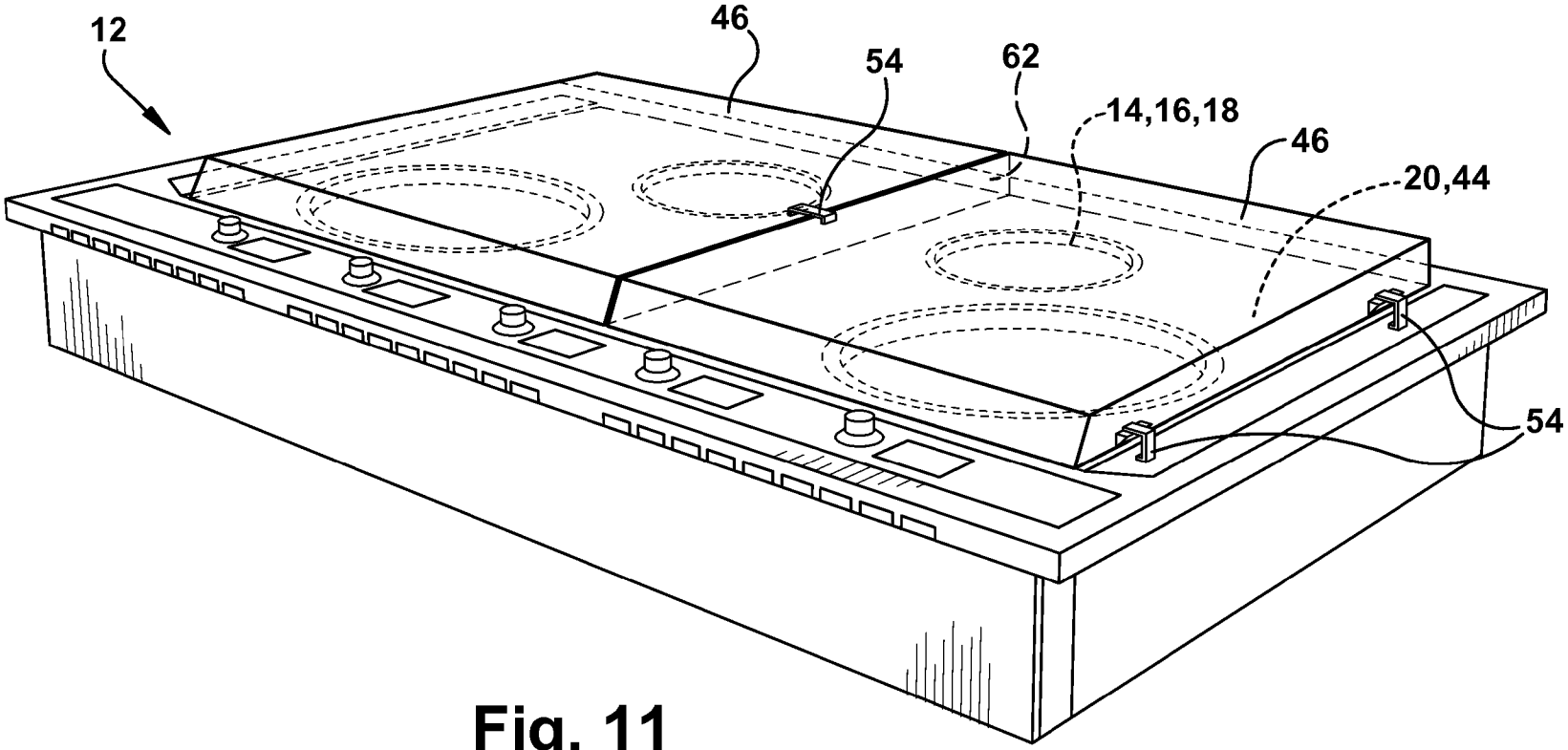
FIG. 11 is a perspective view of the cooktop of FIG. 10, but with the cleaning covers installed on the top surface of the cooktop.

FIG. 10 depicts a cooktop 12 that has a storage feature 48 similar to that shown in FIGS. 6-9, but with two separate, similarly sized covers 46. The cooktop 12 includes openings 48 in the sides of the cooktop 12 that are configured to receive the covers 46. The covers 46 may be suspended from the cooktop 12 in any known manner, or a hanging device 64 can be suspended from the cooktop 12 to serve as a shelf against which the covers 46 may rest when not in use. FIG. 11 depicts the two covers 46 of FIG. 10 removed from the respective recesses 48 and in position on the stove top 20. Each cover 46 covers half of the top of the stove top 20. In this example, both covers 46 may be used at the same time, or each cover 46 may be used independent of the other cover 46. The covers 46 may include locking features 54, as described with prior examples, and may also include a locking feature 54 for locking the two covers 46 together.

Figure 12:
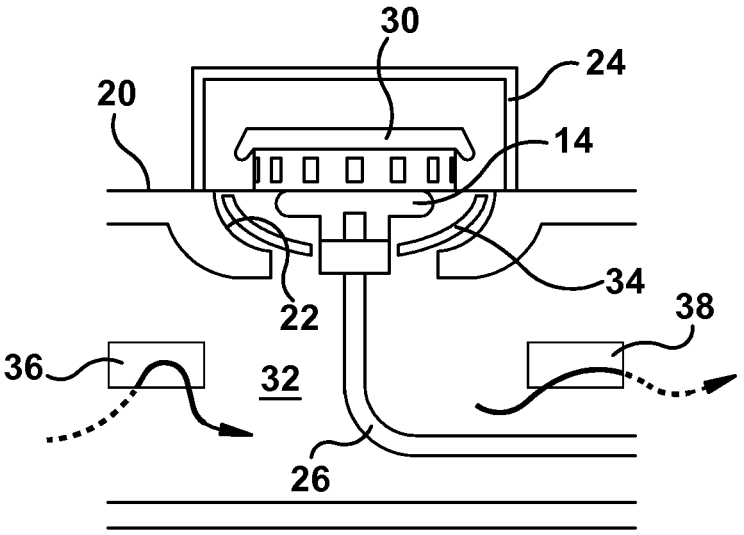
Fig. 12 Prior Art
FIG. 12 is a cross-sectional view of a prior art gas burner.
Figure 13:
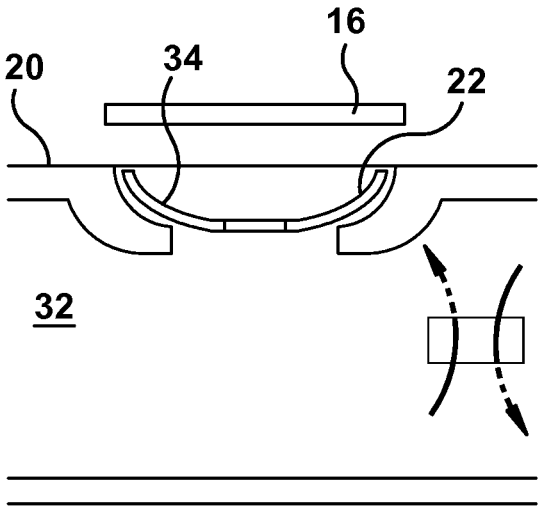
Fig. 13 Prior Art
FIG. 13 is a cross-sectional view of a prior art open electric coil burner.

FIGS. 12 and 13 were previously discussed in the background section. FIG. 12 depicts a prior art gas burner 14 that is positioned in an opening 22 in a stove top 20. The gas burner 14 includes a gas supply 26, a burner 14, and a burner cover 30. A pan 34 is positioned under the burner 14 and a cavity 32 is positioned under the burner 14 and pan 34. A grate 24 is positioned over the burner 14. An air inlet 36 and an air outlet 38 are provided in the cavity 32 of the stove top 20. FIG. 13 depicts an open coil electric burner 16 positioned in an opening 22 of a stove top 20. The burner 16 has a pan 34 positioned under the coil burner 16 and a cavity 32 positioned under the pan 34 and the burner 16. In this example, a single opening 40 is provided for air inlet and outlet. Other types and configurations of air openings 36, 38, 40 may be provided, as known by those of skill in the art.

In the example method of pyrolytically cleaning a top burner, a cover 46 is installed over one or more burners 14, 16, 18 that are positioned on a stove top 20. The cover 46 may optionally be locked in position. Self-cleaning mode is selected on the controller via a knob 28 or switch. Then the burner 14, 16, 18 heats up and additional air may be provided to the burner 14, 16, 18 in order to make the burner 14, 16, 18 burn hotter. Heat from the burner 14, 16, 18 is reflected downwardly from the cover 46 toward the grate 24, pan 34, and surrounding surfaces 20, 44 that are under the cover 46.

A temperature sensor (not shown) is optionally utilized to sense the temperature of the air under the cover 46, and air is cycled through from an inlet to an outlet 36, 38, 40. The inlet 36 may be near the burner 14, 16, 18 or may be provided on the cover 46. Exhaust gases are exhausted to the kitchen environment. The exhaust gases may be exhausted through an exhaust pipe or any other type of exhaust manifold or opening. Temperature is monitored and an algorithm may be optionally utilized to predict when the foodstuffs have been pyrolytically evaporated. After sufficient time has elapsed, the self-cleaning cycle can be turned off while the temperature continues to be monitored. The burner 14, 16, 18 may be allowed to cool. The cover 46 can be unlocked (if previously locked) and removed from the stove top 20. The burner 14, 16, 18 and surrounding surfaces 20, 44 can then be wiped clean of any remaining ashes or products that result from the burning of the foodstuff under the cover 46.

In addition to being used to pyrolytically clean the burners 14, 16, 18 and surrounding area of the stove top 20, the cover 46 may alternatively be left in place on the stove top 20, when desired and when not in use for self-cleaning, to provide additional counter space for the user. If desired, the cover 46 may be decorative in order to enhance the appearance of the cover 46 on the range 10.

A pyrolytic cleaning top burner system for a stove top having at least a normal cooking mode includes a top burner, a cleaning mode, a cover, and a means for heating the top burner. The top burner is coupled to a stove top surface. The cleaning mode is associated with the stove top surface. The cover is for seating on the stove top surface that covers at least the top burner in the cleaning mode. The means for heating heats a top burner to a cleaning temperature in the cleaning mode that permits baked on food matter that is positioned under the cover to be disintegrated with heat.

The system may also include an air inlet associated with the top burner and an exhaust outlet for exhausting air from under the cover. The stove top may include a cavity positioned under the burner, with the burner being a gas burner with a grate positioned over the burner and the cavity. The burner may be a gas burner and may also a grate positioned over the burner and cavity. The burner may be an open coil electric burner. The burner may be a closed top electric burner and may include a plate positioned over the burner that forms a contiguous top surface of the stove top, with the cover seating on the plate.

The burner may be a gas burner and the system may also include a means for regulating the flow of gas to the burner to control the burn temperature of the burner. When the system is in the cleaning mode, a higher rate of flow of gas is permitted than for a cooking mode. The cleaning mode produces a burn temperature that permits the oxidation of food particles, fats, oils, and deposits on the burner or in the vicinity of the burner.

The burner may be an open electric coil burner. When the system is in the cleaning mode, the electric coil burner heats to a temperature that exceeds a normal cooking temperature. In the cleaning mode, the burner produces a burn temperature that permits the oxidation of food particles, fats, oils, and deposits on the burner, base plate or in the cavity.

The burner may be a closed top electric burner having a closed top surface. When the system is in the cleaning mode, the electric burner heats the closed top surface to a temperature that exceeds a normal cooking temperature. In the cleaning mode, the burner produces burn temperature that permit the oxidation of food particles, fats, oils, and deposits on the closed top surface of the range.

The cover may be retractable or removable from the stove top. The stove top may have more than one burner and the cover may have a size to cover one or more burners. The means for heating the top burner may include a heating element and a primary air inlet, which may or may not include a fan for introducing heated or unheated air into the cavity.

The cover may be insulated. The cover may be lockable in place on the stove top. The system may also include one or more air channels coupled to the burner or cavity for one of inputting air under the cover or exhausting air from the cover. The system may include a temperature sensor for sensing the cleaning temperature during the cleaning mode. The system may include a controller coupled to the stove, said controller including programming for a cleaning mode and a cooking mode, with the cooking mode providing temperatures normally associated with cooking and the cleaning mode providing temperatures necessary to disintegrate foodstuffs associated with the stove top and burner when the cover is installed on the stove top. The temperature sensor is coupled to the controller.

A pyrolytic cleaning top burner system for a stove top having at least one top burner having at least a cooking mode for operating the at least one top burner includes a cleaning mode, a cover, and means for heating a top burner to a cleaning temperature in the cleaning mode. The top burner provides burner temperatures that exceed temperatures associated with the cooking mode. The cover covers at least the top burner in a cleaning mode. The means for heating a top burner to a cleaning temperature in the cleaning mode permits baked on food matter that is positioned under the cover to be disintegrated with heat.

The system may further include a controller. Cooking and cleaning modes may be programmed into the controller. The system may include an air inlet coupled with the top burner and an exhaust outlet for exhausting air from under the cover. The air inlet and air outlet are one of integral with one another or separate from one another.

The cover may be retractable or removable from stove top. The stove top may have more than one burner and the cover may have a size to cover one or more burners. The cover may be insulated and lockable in place on the stove top.

A method of pyrolytically cleaning a burner having heating means for raising the temperature of the burner to a cleaning temperature when a cover is installed thereon and a controller for controlling the operation of the burner between a cooking mode and a cleaning mode includes the following steps. Installing a cover over a burner of a stove top. Increasing the temperature of the burner via the controller until a cleaning temperature is achieved. Regulating the temperature to maintain the cleaning temperature via the controller. Exhausting air from under the cover during the cleaning mode. The cleaning temperature may be maintained for a prescribed time period that is anticipated to ensure that any food waste under the cover has been oxidized.

The method may also include sensing a temperature at the burner and using an algorithm based in part on the temperature to predict when the food waste has oxidized. The method may further include locking the cover on the stove top in the cleaning mode and adding air under the cover during the cleaning mode to raise the temperature of the burner to the cleaning temperature. The method may also include controlling the flow of gas to the burner until the cleaning temperature is achieved and controlling the flow of gas to the burner in order to maintain the cleaning temperature for the prescribed time period.

The method may further include turning the burner off and waiting for a period of time until the cover and stove top have cooled, one of signaling that the cover can be unlocked after the waiting period of time has expired, or automatically unlocking the cover after the waiting period of time has expired, and unlocking the cover. The method may also include removing the cover from the stove top, stowing the cover in a recess that is coupled to the stove top or stowing the cover in another location removed from the stove top, and wiping any remaining food residue from the stove top.

While the above-described system and method is described in the context of a range, other types of devices similar to a range may find a benefit from the invention, such as portable ranges or cooktops, among other devices.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A pyrolytic cleaning top burner system for a stove top having at least a normal cooking mode, said system comprising:

a top burner at a stove top surface;

a cleaning mode associated with the stove top surface;

a cover for seating on the stove top surface that covers at least the top burner in the cleaning mode;

a sensor for sensing when the cover is seated on the stove top surface;

a temperature sensor for sensing the cleaning temperature during the cleaning mode; and means for heating a top burner to a cleaning temperature in the cleaning mode that permits baked on food matter that is positioned under the cover to be disintegrated with heat.

2. The system of claim 1, further comprising an air inlet associated with the top burner; and an exhaust outlet for exhausting air from under the cover.

3. The system of claim 1, wherein the stove top further comprises:

a cavity positioned under the burner;

wherein the burner is a gas burner and further comprising a grate positioned over the burner and cavity; or wherein the burner is an open coil electric burner; or wherein the burner is a closed top electric burner and further comprising a plate positioned over the burner and forming a contiguous top surface of the stove top, with the cover seating on the plate.

4. The system of claim 3, wherein the burner is a gas burner and further comprising a means for regulating the flow of gas to the burner to control the burn temperature of the burner, wherein when in the cleaning mode, a higher rate of flow of gas is permitted than for a cooking mode, with the cleaning mode producing a burn temperature that permits the oxidation of food particles, fats, oils, and deposits on the burner or in the vicinity of the burner.

5. The system of claim 3, wherein the burner is an open electric coil burner and when in the cleaning mode, the electric coil burner heats to a temperature that exceeds a normal cooking temperature, with the cleaning mode producing a burn temperature that permits the oxidation of food particles, fats, oils, and deposits on the burner, base plate or in the cavity.

6. The system of claim 3, wherein the burner is a closed top electric burner having a closed top surface and when in a cleaning mode, the electric burner heats the closed top surface to a temperature that exceeds a normal cooking temperature, with the cleaning mode producing a burn temperature that permits the oxidation of food particles, fats, oils, and deposits on the closed top surface of the range.

7. The system of claim 1, wherein the cover is one of retractable or removable from the stove top; or wherein the stove top has more than one burner and the cover has a size to cover one or more burners.

8. The system of claim 1, wherein the means for heating the top burner includes a heating element and a primary air inlet, which may or may not include a fan for introducing heated or unheated air into the cavity.

9. The system of claim 1, wherein the cover is insulated and the cover is lockable into place on the stove top.

10. The system of claim 3, further comprising one or more air channels coupled to the burner or cavity for one of inputting air under the cover or exhausting air from the cover.

11. The system of claim 1, further comprising a controller coupled to the stove, said controller including programming for a cleaning mode and a cooking mode, with the cooking mode providing temperatures normally associated with cooking and the cleaning mode providing temperatures necessary to disintegrate foodstuffs associated with the stove top and burner when the cover is installed on the stove top, wherein the temperature sensor is coupled to the controller.

12. A pyrolytic cleaning top burner system for a stove top having at least one top burner having at least a cooking mode for operating the at least one top burner, said system comprising:

a cleaning mode providing burner temperatures that exceed temperatures associated with the cooking mode;

a cover that covers at least the top burner in a cleaning mode;

a sensor for sensing when the cover is seated on the stove top surface;

a temperature sensor for sensing the cleaning temperature during the cleaning mode; and means for heating a top burner to a cleaning temperature in the cleaning mode that permits baked on food matter that is positioned under the cover to be disintegrated with heat.

13. The system of claim 12, further comprising a controller, wherein the cooking and cleaning modes are programmed into the controller.

14. The system of claim 12, further comprising an air inlet coupled to the top burner and an exhaust outlet for exhausting air from under the cover, wherein the air inlet and air outlet are one of integral with one another or separate from one another.

15. The system of claim 12, wherein the cover is one of retractable or removable from stove top; or wherein the stove top has more than one burner and the cover has a size to cover one or more burners.

16. The system of claim 13, wherein the cover is insulated and the cover is lockable into place on the stove top.

17. A method of pyrolytically cleaning a burner, said method comprising:

installing a cover over a burner of a stove top;

sensing that the cover is positioned over the burner of the stove top;

measuring the temperature of under the cover;

increasing the temperature of the burner until a cleaning temperature is achieved;

regulating the temperature of the burner to maintain the cleaning temperature; and exhausting air from under the cover during the cleaning mode, wherein the cleaning temperature of the burner is maintained for a prescribed time period that is anticipated to ensure that any food waste under the cover has been oxidized.

18. The method of claim 17, further comprising:

sensing a temperature at the burner and using an algorithm based in part on the temperature to predict when the food waste has oxidized;

locking the cover on the stove top in the cleaning mode;

adding air under the cover during the cleaning mode to raise the temperature of the burner to the cleaning temperature; and controlling the flow of gas to the burner until the cleaning temperature is achieved and controlling the flow of gas to the burner in order to maintain the cleaning temperature for the prescribed time period.

19. The method of claim 17, further comprising:

turning the burner off and waiting for a period of time until the cover and stove top have cooled;

one of signaling that the cover can be unlocked after the waiting period of time has expired, or automatically unlocking the cover after the waiting period of time has expired;

unlocking the cover;

removing the cover from the stove top;

stowing the cover in a recess that is coupled to the stove top or stowing the cover in another location removed from the stove top; and wiping any remaining food residue from the stove top.

* * * * *